United States Patent [19]

Bernstein et al.

[11] Patent Number: 4,877,932

[45] Date of Patent: Oct. 31, 1989

[54] MICROWAVE CONTAINER ASSEMBLY

[75] Inventors: Linda A. Bernstein, Cambell Hall; Robert L. Gordon, Monroe, both of N.Y.

[73] Assignee: International Paper Company, Purchase, N.Y.

[21] Appl. No.: 232,048

[22] Filed: Aug. 15, 1988

[51] Int. Cl.[4] ..... H05B 6/80

[52] U.S. Cl. ..... 219/10.55 E; 219/10.55 F; 99/DIG. 14; 426/107; 426/243

[58] Field of Search ..... 219/10.55 E, 10.55 F, 219/10.55 R; 426/122–124, 106–113, 234, 237, 241, 243; 220/410; 206/583, 45.15, 45.12, 45.21

[56] References Cited

U.S. PATENT DOCUMENTS

| | | | |
|---|---|---|---|
| Re. 24,037 | 7/1955 | Willits . | |
| 1,908,841 | 5/1933 | Hawks . | |
| 1,955,663 | 4/1934 | Wendell . | |
| 2,245,064 | 6/1941 | Bemiss . | |
| 2,522,049 | 9/1950 | Lang . | |
| 2,636,600 | 4/1951 | Denton . | |
| 2,944,717 | 7/1960 | Lynch . | |
| 3,184,139 | 5/1965 | Conescu . | |
| 3,195,796 | 7/1965 | Buttery . | |
| 3,309,005 | 3/1967 | Pilger . | |
| 3,519,190 | 7/1970 | Achermann . | |
| 3,591,071 | 7/1971 | Rosenburg | 229/51 TC |
| 3,964,671 | 6/1976 | Steel | 229/51 TC |
| 4,279,374 | 7/1981 | Webinger | 229/34 R |
| 4,592,914 | 6/1986 | Kuchenbecke | 219/10.55 E |
| 4,626,641 | 12/1986 | Brown | 219/10.55 E |
| 4,661,672 | 4/1987 | Nakanaga | 219/10.55 E |

*Primary Examiner*—A. D. Pellinen
*Assistant Examiner*—Leon K. Fuller
*Attorney, Agent, or Firm*—Walt Thomas Zielinski

[57] ABSTRACT

A paperboard container assembly for the microwave cooking and browning of food. The assembly is defined by an outer carton which surrounds a separate elongated tray. The tray is formed of a unitary blank of paperboard, a microwave interactive material and a polymer coating. The interactive material browns and crisps the food surface where contacted. The ends of the tray carry elongated, hollow feet to both support the tray bottom in vertially spaced relation to the carton bottom and to prevent shifting of the tray relative to the carton. Openings along the tray sidewalls and hollow feet prevent both scorching or burning of the paperboard and delamination of the polymer coating due to localized heat build-up.

7 Claims, 4 Drawing Sheets

MICROWAVE CONTAINER ASSEMBLY

BACKGROUND OF THE INVENTION

This invention relates to a container assembly for microwave cooking, more particularly to the microwave cooking of foodstuffs, such as French bread pizza, which are improved in appearance and texture by being at least partially browned or crisped upon microwave cooking.

A variety of foodstuff browning or crisping package constructions, particularly for frozen foods, is known in this art. For example, U.S. Pat. Nos. 4,230,924 and 4,267,420, issued to Brastad, disclose that paperboard may be provided with a relatively thin layer of aluminum film, with the aluminum acting as interactive material whose temperature will be increased upon the absorption of microwave energy from a conventional microwave oven. This local absorption of heat provides a browning or crisping to the surface of a foodstuff which contacts the paperboard. Typically, paperboard is provided with a coating of polyethylene terephlythalate (PET) beneath which is positioned a layer of vacuum deposited aluminum, the aluminum thus sandwiched between the PET and a paperboard substrate. One or more layers of an adhesive are generally employed to maintain this laminate.

Certain types of frozen foodstuffs are particularly adapted for browning or crisping using such a microwave interactive laminate or construction. For example, pizza, when conventionally cooked, displays a browning or crisping on the bottom of the dough, with the top of the pizza being at least partially melted. A consumer convenient package may be formed which includes a paperboard laminate of the microwave interactive material described above, with a frozen pizza placed in a tray or traylike support, with the tray and the pizza therein being inserted in an outer container. For use, the consumer has often had to manipulate the outer container or a separate spacer member after opening of the package, in order to place the tray in some desired position relative to the package and thus relative to the bottom of a conventional microwave oven.

The manipulation by the consumer of such a frozen food package represents an inconvenience. The consumer must take time to read and properly understand the instructions for such manipulation. For example, in one such commercially available package, a French bread pizza is placed within a tray, the tray being provided on at least a major portion of its surfaces with microwave interactive material to thereby brown or crispen the frozen pizza. The consumer must remove the tray from the outer carton, remove the frozen pizza from a pouch or other covering, place a spacer member between the tray and the bottom of the carton, and reinsert the tray into the outer carton for final cooking in the microwave oven.

SUMMARY OF THE INVENTION

According to the practice of this invention, a container assembly is provided requiring a minimum of manipulations by the consumer prior to cooking a frozen foodstuff, such as as frozen French bread pizza. In the assembly of this invention, a novel tray is placed in an outer container, with the pizza, conventionally, being wrapped in a pouch or the like to preserve its freshness. In a preferred manner of use, the consumer rips off the top of the outer container, removes the pizza, removes the frozen pizza from its pouch, places the frozen pizza back into the tray, and then places the tray and its surrounding, now open topped outer carton in a microwave oven for cooking. The tray, by virtue of its construction, is automatically elevated a desired distance above the bottom of the outer carton, and thus elevated above the bottom of a microwave oven. The tray is provided with integral supporting feet to properly maintain this vertical spacing. The feet are of such a configuration as to prevent shifting of the tray relative to the outer carton and to provide strength to the tray bottom. Previous attempts to elevate the tray above the bottom of the outer container employed extensions of the side panels of the tray, the extensions running vertically with respect to the outer carton base. These extensions were unstable and weak. By the practice of this invention, the supporting legs are fashioned from the same material forming the tray, the feet each being in the general form of a tube. The ends of each foot abut a respective side wall of the outer carton and thereby prevent any shifting of the tray relative to the outer carton.

DETAILED DESCRIPTION OF THE DRAWINGS

Figure 1:
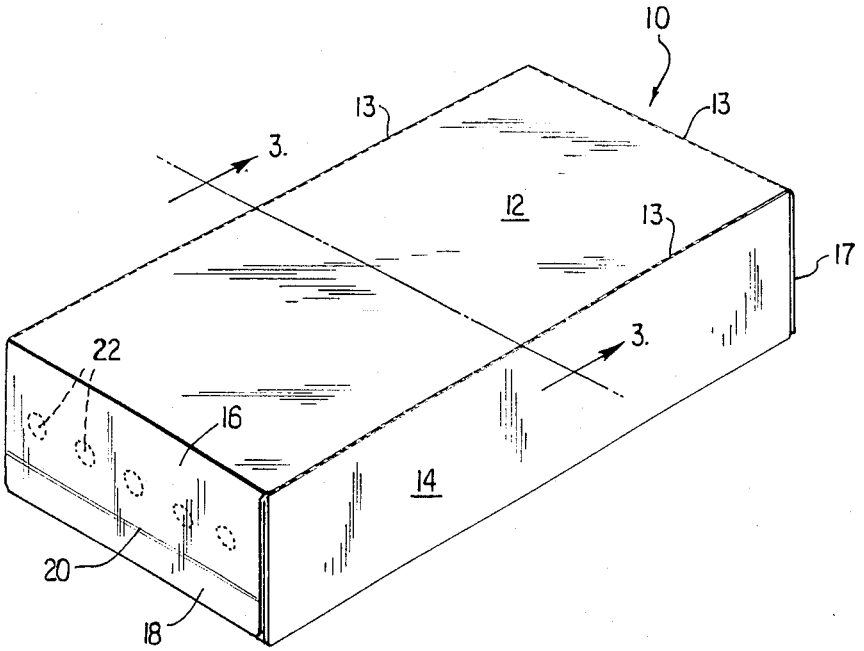
FIG. 1 is a perspective view of the container assembly of this invention prior to opening.
Figure 2:
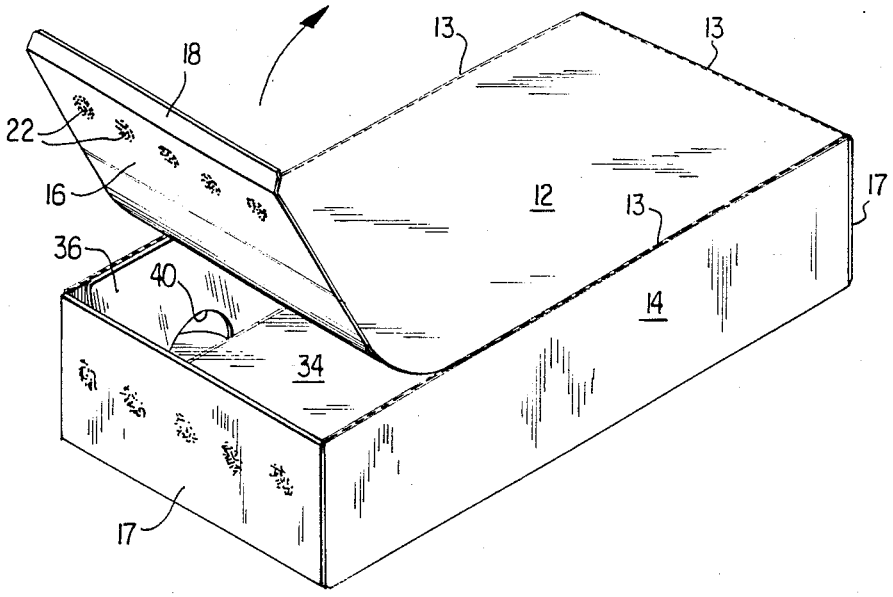
FIG. 2 is a view illustrating the assembly of FIG. 1 partially open.

Referring now to the drawings, the numeral 10 denotes generally the container assembly of this invention and is defined by an outer paperboard carton having a tray therein. A frozen foodstuff, (shown in phantom lines at FIG. 3) typically French bread pizza, is supported on the tray. The top wall 12 of the outer container is provided with a plurality of perforated lines 13 running along both edges of the top and along one top wall end edge. The other top wall end edge carries an integral flap 16 having an integral tongue 18 which is to be manually grasped for opening. A scoreline 20 is provided at the base of tongue 18. The container includes a pair of oppositely disposed sidewalls 14, a bottom wall 15, end panels 17 and end tongues 19. As shown at FIG. 2, initial opening of the outer carton is achieved by pulling tongue 18 to pull end panel 16 upwardly, this latter panel held in its closed position next to a panel 17 in the outer container by a plurality of spaced dabs of an adhesive, indicated by the numeral 22. The top 12 is completely ripped along perforated lines 13, and removed and discarded.

Figure 4:
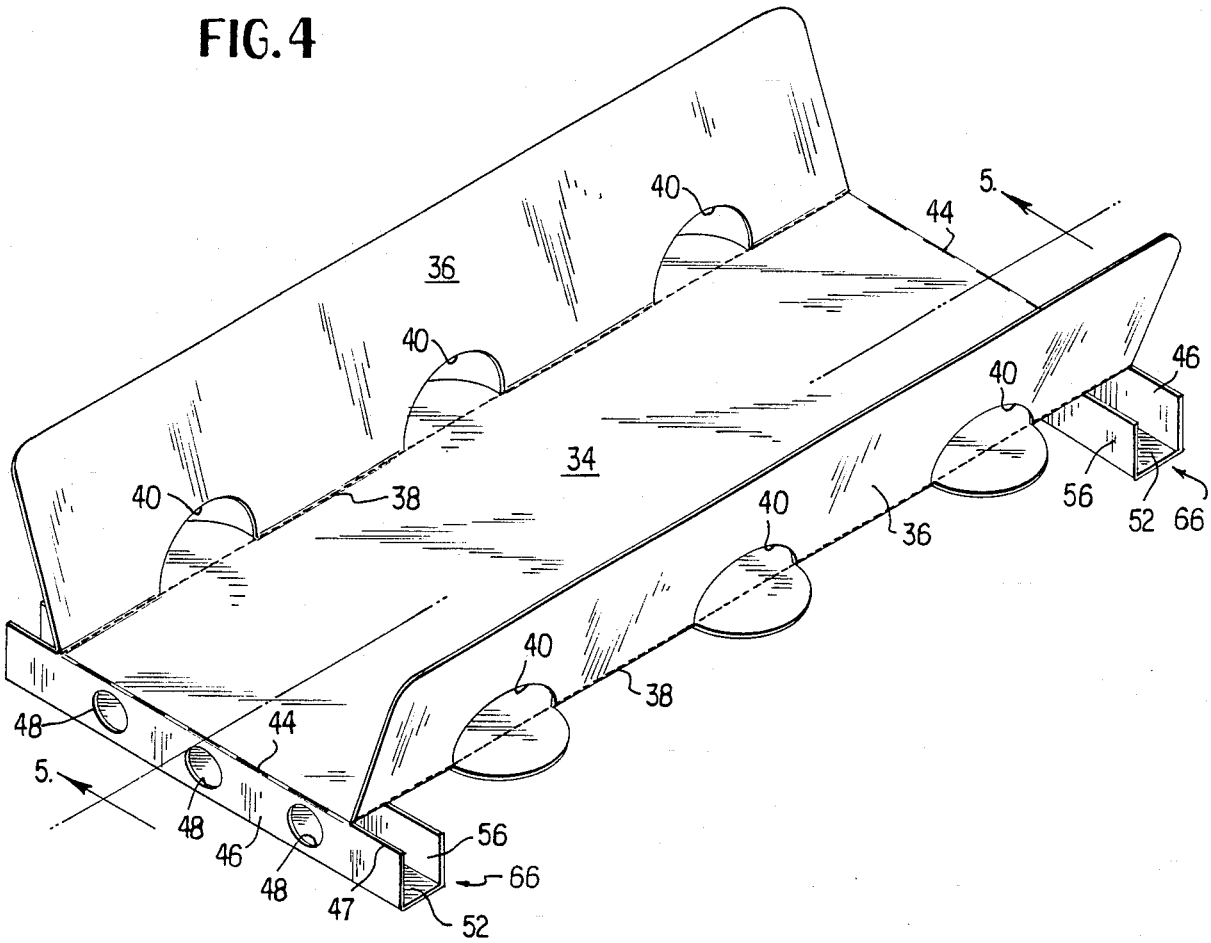
FIG. 4 is a perspective view of the tray of the container assembly of this invention.
Figure 5:
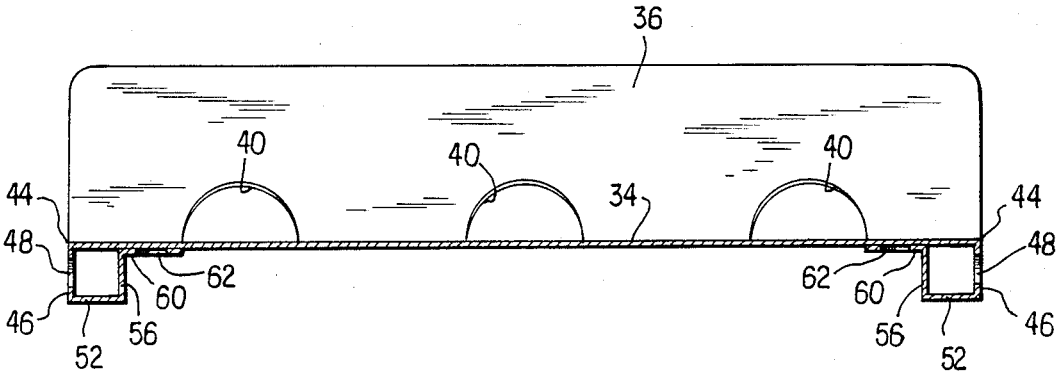
FIG. 5 is a section along section 5—5 of FIG. 4.
Figure 6:
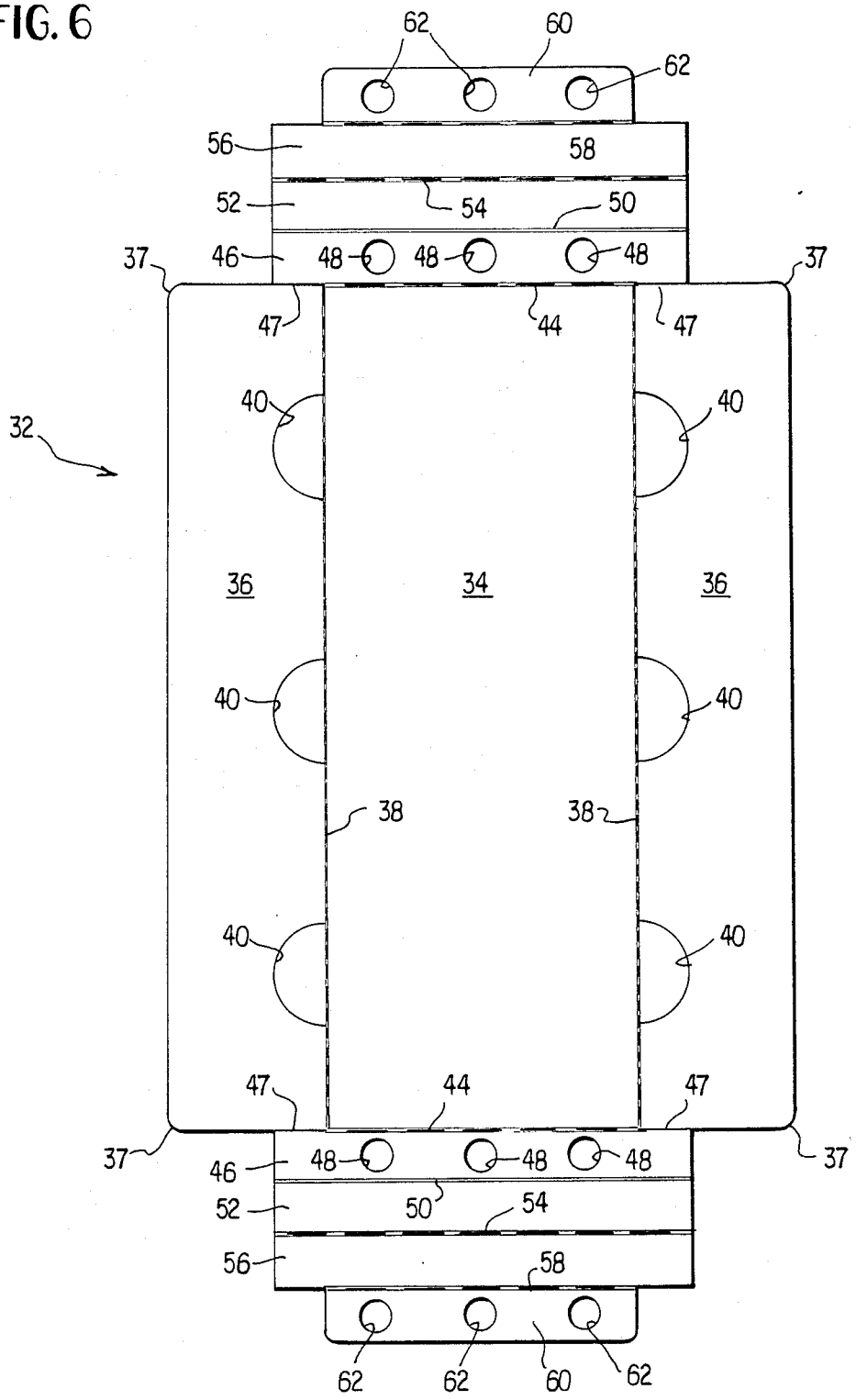
FIG. 6 is a plan view of a unitary blank from which the tray of FIG. 4 is formed.

Referring now particularly to FIGS. 4, 5 and 6 of the drawings, the numeral 32 denotes generally the browning tray of the container assembly. FIG. 4 illustrates the tray in its assembled configuration, while FIG. 6 illustrates a unitary blank of a laminate including paperboard or other stiff, resilient and bendable dielectric material for forming it. The tray has a bottom wall 34 and a pair of oppositely disposed sidewalls 36. A series of perforated lines 38 define a hinge for each sidewall, with numeral 40 denoting cuts completely through the blank to define a series of longitudinally spaced half circular openings 42 along each sidewall. The numeral 44 denotes a perforated fold line at either end of the tray bottom. A panel 46 at each end of bottom wall 34 is foldably secured to the latter by a respective perforated line 44. The numeral 47 denotes any one of four cut lines. Panel 46 is provided with a plurality of circular openings 48 spaced therealong. The numeral 50 denotes a fold line securing panel 46 to panel 52, the latter provided on its opposite longitudinal edge with a perforated line 54. Panel 56 is secured on one longitudinal edge to panel 52 by perforated line 54 and is secured along an opposite longitudinal edge to a panel 60 by means of perforated line 58. Panel 60 is provided with a plurality of circular openings 62 spaced therealong. The numeral 37 denotes the rounded corners of the outer edges of sidewalls 36. The tray and blank both exhibit mirror symmetry about an imaginary longitudinal axis extending midway along bottom wall 34.

The panels 46, 52, 56 and 60 are folded to form an elongated hollow foot 66 at each end of the tray. Opposite ends of each foot 66 abut respective opposite sidewalls 14 of the outer container to thereby prevent shifting of the tray relative to the outer container.

Tray 32 is fashioned from a laminate including paperboard provided with an upper, food contacting surface of, typically, polyethylene terephlythalate (PET) or other polymer. A microwave interactive material, such as vacuum deposited aluminum, is positioned between the paperboard which forms the tray 32 and the PET coating, with one or more layers of adhesive securing this laminate together. The manner of construction of food browning laminates including a polymer-paperboard-microwave interactive material is known to workers in this art and forms no part of this invention.

Figure 3:
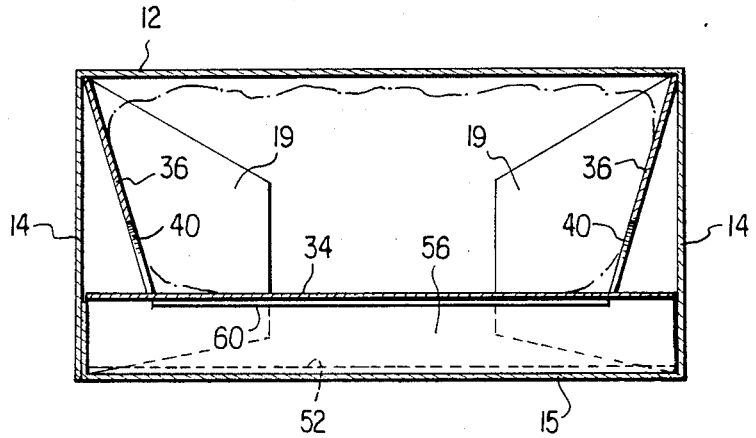
FIG. 3 is a view taken along Section 3—3 of FIG. 1.

As shown at FIG. 3, the upper edges of sidewalls 36 rest against and are laterally supported by the upper edges of sidewalls 14 of the outer carton. This support is necessary to maintain the sides of a frozen food product, shown in phantom lines in surface contact with tray sidewalls 36. The upper edges of the tray sidewalls are in essentially the same plane as the plane containing top 12 of the outer carton or container.

Referring again to FIGS. 4 and 6, the perforations which define fold lines 38 serve a dual purpose. Firstly, they provide a foldable edge for the sidewalls and also effect an interruption in the heat absorption of the microwave interactive material to thus inhibit scorching or burning of the food product being cooked and browned. This interruption or reduction of heat, by the perforated fold lines 38, also inhibits blistering and delamination of the PET layer of the laminate. As seen at FIG. 5, the end panel 60 of each elongated, hollow foot 66 extends horizontally and is glued to the lower surface of tray bottom wall 24. This panel is provided with spaced openings 62. These openings inhibit burning or scorching of the laminate material, which might otherwise occur because of the double thickness of the microwave interactive material. The semi-circular openings 42 also serve a dual function. They inhibit scorching and burning of the food product by interrupting the microwave energy, and further provide for venting of hot air or steam which may be trapped under the frozen food product in the tray. The rounded corners 37 assist in loading or insertion of the tray into the outer carton at the place of assembly of the complete package. If corners 37 were instead square, they might tend to become "hung up" during loading. Typically, the area of tray bottom wall 34 and sidewalls 36 corresponds to the bottom and side external dough area of the frozen food product, to thereby insure maximum contact therewith to accordingly maximize browning and crisping.

The function of openings 48 in elongated feet 66 is also to interrupt the microwave energy absorbed by the feet during cooking, as do openings 62, and thus prevent scorching or burning of the laminate. If the elongated feet 66, defined by panels 46, 52, 58 and 60, were formed from paperboard only, for example, the openings 48 and 62 would not be required. It has been found convenient to die cut an entire, unitary blank, such as shown at FIG. 6, from a laminate of the abovedescribed microwave interactive material. The function of perforated line 58 on each foot 66 assists in cooling of the feet, as well as folding between panels 56 and 60. The same is true for perforated lines 44.

Figure 7:
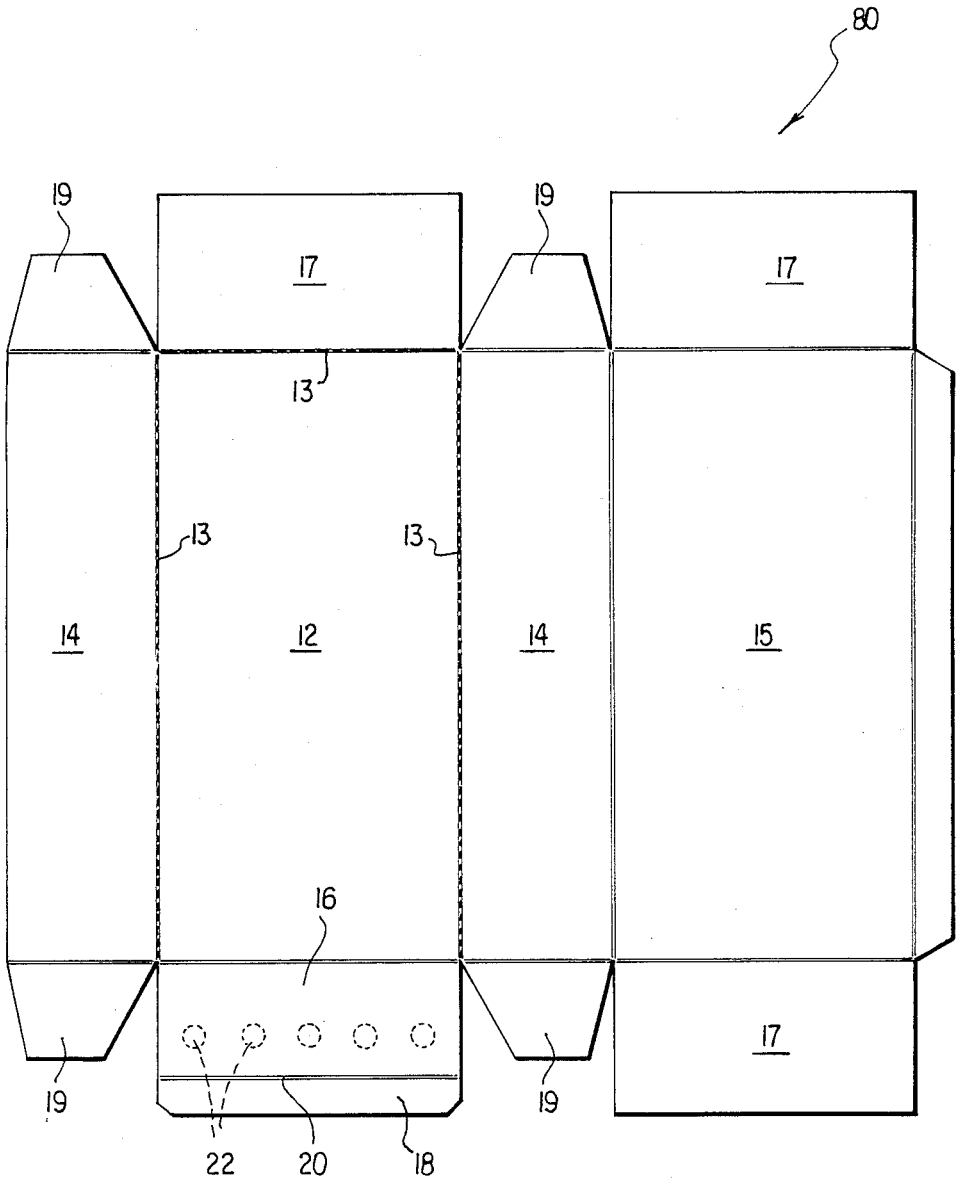
FIG. 7 is a view of the blank from which the outer container of the container assembly of this invention is formed.

FIG. 7 illustrates the interior side of a unitary paperboard blank of paperboard or other stiff, foldable and resilient sheet dielectric material from which the outer carton is formed. The end closure panels 17 and tongues 19 are secured in lapped relation by an adhesive. The manufacturer's flap is secured as by adhesive to the inside of the left or free edge of left sidewall 14. The outer container is initially folded and glued to form a tube structure, with one end being closed. The tray and frozen food product are then placed into the open end and flap 16 is glued by means of dabs 22 to an end panel 17, as readily visualized from FIG. 2.

It will be understood that the outer carton may be formed from any of a variety of blanks other than that illustrated and, further, may be formed from more than one blank.

As can readily be understood from a consideration of FIG. 2, the outer carton is opened by ripping off top panel 12 and the frozen food product, typically wrapped in a container or pouch, is taken off the tray and removed from the pouch. The frozen food product is then placed back in the tray, the tray remaining in the now open outer container. The assembly is now placed in a microwave oven and cooked and browned.

What is claimed is:

1. A container assembly for the packaging of frozen foodstuffs which are to be cooked and browned in a microwave oven, the assembly including an outer carton formed of dielectric material and including a top panel, bottom panel, opposite sidewalls, and opposite end walls, said top panel including means to facilitate its manual removal from the remaining portions of the outer carton, a tray in the carton, the tray being formed from dielectric sheet material, such as paperboard, the tray including a bottom wall having upwardly sloping, opposite sidewalls, said sidewalls having upper, longitudinally extending edges, the tray bottom wall being parallel to and spaced from the outer carton bottom panel, the tray having a supporting foot at each opposite end thereof extending downwardly relative to said bottom wall of the tray and contacting the bottom wall of the tray, each foot being substantially hollow and elongated and being in the form of a tube where it contacts the tray bottom, having a surface thereof resting on said bottom panel of the outer carton, the ends of each said elongated foot abutting a respective opposite side wall of the outer carton to thereby inhibit relative movement between the tray and the outer carton, at least a portion of the tray bottom wall and tray sidewall surfaces carrying a microwave interactive material, the upper, food contacting surfaces of the tray bottom and sidewalls coated with a polymer.

2. The microwave container assembly of claim 1 wherein said tray is formed from a unitary blank of a laminate which includes a layer of a microwave interactive material, a layer of paperboard, and a polymer layer.

3. The microwave container assembly of claim 2 wherein the junction of said sloping tray sidewalls to the tray bottom include perforations, said perforations facilitating bending of the sidewalls relative to the tray bottom and also interrupting the absorption of microwave energy to inhibit blistering of said polymer.

4. The microwave container assembly of claim 2 wherein each tray sloping sidewall is provided with a plurality of openings bordering on the junction each said sidewall and said tray bottom wall, said openings interrupting the absorption of microwave energy to inhibit blistering of said polymer and also facilitating venting of hot air or steam from the bottom of a foodstuff on the tray.

5. The microwave container assembly of claim 1 wherein the upper edges of each sidewall of the tray bear against a respective opposite sidewall of said outer carton to thereby maintain each sidewall in a desired angle to the tray bottom.

6. The microwave container assembly of claim 1 wherein each said elongated foot includes a horizontal panel attached to the bottom surface of said tray bottom wall, each said panel having a plurality of openings therealong to thereby inhibit scorching of the tray.

7. The microwave container assembly of claim 1 wherein said elongated, hollow feet each include vertically extending panels, at least one of which is provided with openings therealong.

* * * * *